US009415584B2

(12) United States Patent
Shibata et al.

(10) Patent No.: US 9,415,584 B2
(45) Date of Patent: Aug. 16, 2016

(54) LIQUID DISCHARGE HEAD SUBSTRATE, LIQUID DISCHARGE HEAD, AND PRINTING APPARATUS

(71) Applicant: CANON KABUSHIKI KAISHA, Tokyo (JP)

(72) Inventors: Masanori Shibata, Inagi (JP); Tatsuhito Goden, Machida (JP); Kazunari Fujii, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/791,983

(22) Filed: Jul. 6, 2015

(65) Prior Publication Data

US 2016/0039200 A1 Feb. 11, 2016

(30) Foreign Application Priority Data

Aug. 7, 2014 (JP) ..... 2014-161896

(51) Int. Cl.

| | |
|---|---|
| ***B41J 29/393*** | (2006.01) |
| ***B41J 2/045*** | (2006.01) |
| ***B41J 2/335*** | (2006.01) |
| ***B41J 2/355*** | (2006.01) |
| ***B41J 2/36*** | (2006.01) |
| ***B41J 2/37*** | (2006.01) |

(52) U.S. Cl.

CPC ..... *B41J 2/04541* (2013.01); *B41J 2/0453* (2013.01); *B41J 2/0455* (2013.01); *B41J 2/0457* (2013.01); *B41J 2/0458* (2013.01); *B41J 2/04506* (2013.01); *B41J 2/04555* (2013.01); *B41J 2/04586* (2013.01); *B41J 2/3352* (2013.01); *B41J 2/3558* (2013.01); *B41J 2/362* (2013.01); *B41J 2/37* (2013.01)

(58) Field of Classification Search

CPC .... B41J 2/04506; B41J 2/0453; B41J 2/0455; B41J 2/04555; B41J 2/0457; B41J 2/0458; B41J 2/3352; B41J 2/3558; B41J 2/362; B41J 2/37

See application file for complete search history.

(56) References Cited

U.S. PATENT DOCUMENTS

| | | | | |
|---|---|---|---|---|
| 5,422,662 A * | 6/1995 | Fukushima | B41J 2/37 | 347/211 |
| 6,068,360 A * | 5/2000 | Hiwada | B41J 2/04541 | 347/14 |
| 7,350,891 B2 * | 4/2008 | Oomura | B41J 2/04513 | 347/9 |
| 2002/0033864 A1 * | 3/2002 | Hopkins | B41J 2/04518 | 347/59 |

FOREIGN PATENT DOCUMENTS

JP 2010-155452 A 7/2010

* cited by examiner

*Primary Examiner* — Julian Huffman

(74) *Attorney, Agent, or Firm* — Fitzpatrick, Cella, Harper & Scinto

(57) ABSTRACT

A liquid discharge head substrate is provided. The liquid discharge head substrate includes a discharge unit including a discharge element configured to generate energy for discharging a liquid from an orifice and a discharge control circuit configured to control the discharge element, and a first voltage generation circuit configured to supply, to the discharge control circuit, a first driving voltage for driving the discharge control circuit. The discharge unit includes a first node having a voltage correlated with a voltage to be supplied to the discharge element. The first voltage generation circuit controls the first driving voltage based on a comparison result of the voltage of the first node and a first reference voltage supplied from outside of the liquid discharge head substrate.

19 Claims, 9 Drawing Sheets

LIQUID DISCHARGE HEAD SUBSTRATE, LIQUID DISCHARGE HEAD, AND PRINTING APPARATUS

BACKGROUND OF THE INVENTION

1. Field of the Invention

The present invention relates to a liquid discharge head substrate, a liquid discharge head, and a printing apparatus.

2. Description of the Related Art

Japanese Patent Laid-Open No. 2010-155452 describes a liquid discharge head substrate that suppresses the influence of the voltage variation of a power supply line which supplies power to a discharge element for discharging a liquid. In this liquid discharge head substrate, transistors are connected to the two terminals of the discharge element. These transistors control a voltage and a current applied to the discharge element. This makes it possible to stably supply power to the discharge element.

SUMMARY OF THE INVENTION

The present inventors have found that the characteristics of transistors which drive discharge elements may vary, depending on the accuracy of the manufacturing process of a liquid discharge head substrate, among a plurality of liquid discharge head substrates obtained from different wafers or different chips. As a result, power supplied to the discharge elements may vary. Some embodiments of the present invention provide a technique of suppressing variations in the power supplied to the discharge elements among the liquid discharge head substrates.

According to some embodiments, a liquid discharge head substrate comprising a discharge unit including a discharge element configured to generate energy for discharging a liquid from an orifice and a discharge control circuit configured to control the discharge element; and a first voltage generation circuit configured to supply, to the discharge control circuit, a first driving voltage for driving the discharge control circuit, wherein the discharge unit includes a first node having a voltage correlated with a voltage to be supplied to the discharge element, and the first voltage generation circuit controls the first driving voltage based on a comparison result of the voltage of the first node and a first reference voltage supplied from outside of the liquid discharge head substrate, is provided.

According to some other embodiments, a liquid discharge head substrate comprising a discharge unit including a discharge element configured to generate energy for discharging a liquid from an orifice and a discharge control circuit configured to control the discharge element; and a first voltage generation circuit configured to supply, to the discharge control circuit, a first driving voltage for driving the discharge control circuit, wherein the first voltage generation circuit controls the first driving voltage based on a comparison result of a voltage of one terminal of the discharge element and a first reference voltage supplied from outside of the liquid discharge head substrate, is provided.

According to some other embodiments, a liquid discharge head comprising a liquid discharge head substrate and a liquid supply unit, wherein the liquid discharge head substrate comprises: a discharge unit including a discharge element configured to generate energy for discharging a liquid from an orifice and a discharge control circuit configured to control the discharge element; and a first voltage generation circuit configured to supply, to the discharge control circuit, a first driving voltage for driving the discharge control circuit, the discharge unit includes a first node having a voltage correlated with a voltage to be supplied to the discharge element, the first voltage generation circuit controls the first driving voltage based on a comparison result of the voltage of the first node and a first reference voltage supplied from outside of the liquid discharge head substrate; and the liquid supply unit is configured to supply a liquid to the liquid discharge head substrate, is provided.

According to some other embodiments, a printing apparatus comprising a liquid discharge head which comprising a liquid discharge head substrate and a liquid supply unit, and a driving unit, wherein the liquid discharge head substrate comprises a discharge unit including a discharge element configured to generate energy for discharging a liquid from an orifice and a discharge control circuit configured to control the discharge element; and a first voltage generation circuit configured to supply, to the discharge control circuit, a first driving voltage for driving the discharge control circuit, the discharge unit includes a first node having a voltage correlated with a voltage to be supplied to the discharge element, the first voltage generation circuit controls the first driving voltage based on a comparison result of the voltage of the first node and a first reference voltage supplied from outside of the liquid discharge head substrate; the liquid supply unit is configured to supply a liquid to the liquid discharge head substrate; and the driving unit is configured to drive the liquid discharge head, is provided.

Further features of the present invention will become apparent from the following description of exemplary embodiments (with reference to the attached drawings).

DESCRIPTION OF THE EMBODIMENTS

Figure 1:
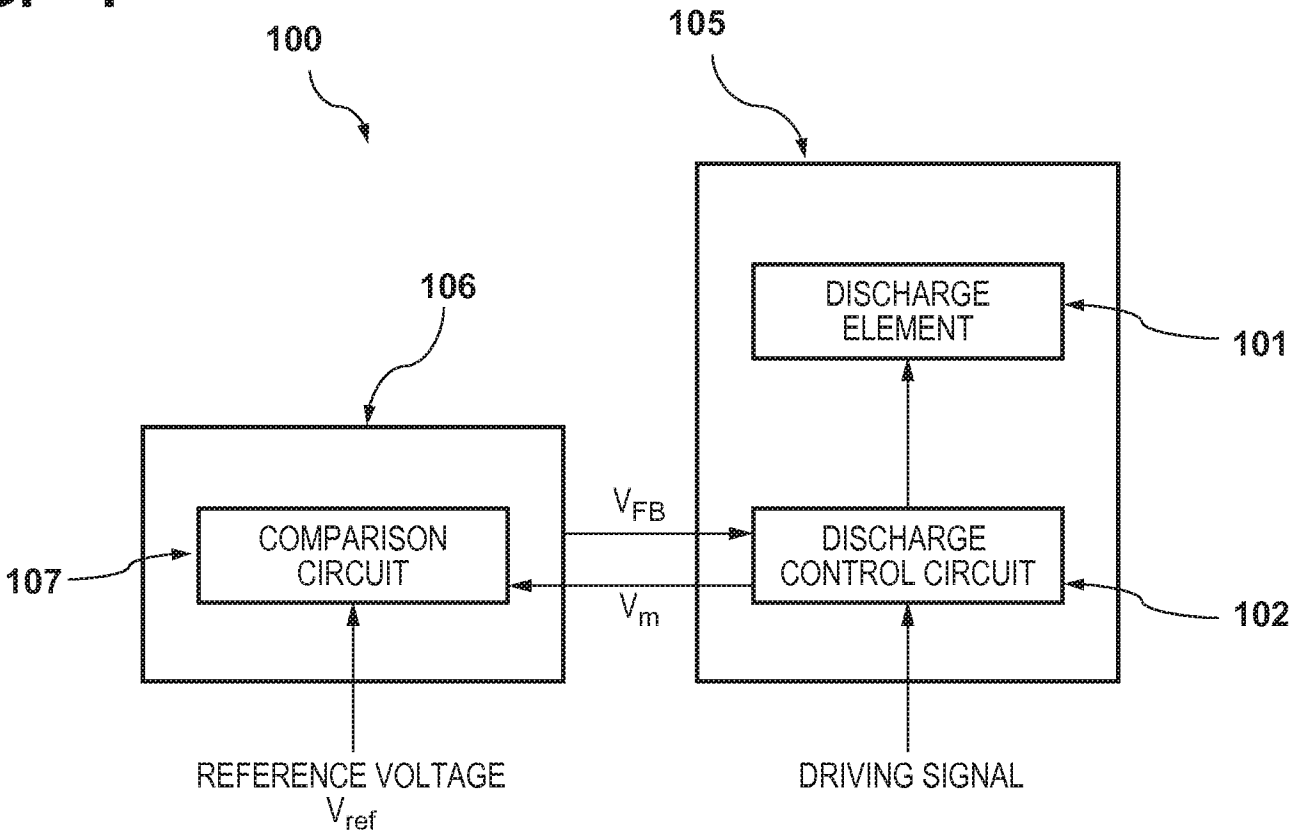
FIG. 1 is a block diagram showing the arrangement of a liquid discharge head substrate according to an embodiment of the present invention.

A liquid discharge head substrate according to some embodiments of the present invention will be described with reference to FIG. 1. FIG. 1 is a block diagram schematically showing the arrangement of a liquid discharge head substrate 100 according to an embodiment of the present invention. The liquid discharge head substrate 100 includes a discharge element 101, a discharge control circuit 102, and a voltage generation circuit 106. The discharge element 101 and the discharge control circuit 102 form a discharge unit 105. The liquid discharge head substrate 100 generally includes the plurality of discharge units 105. The discharge element 101 discharges a liquid from an orifice by applying energy to the liquid. The discharge element 101 may be a heating element which applies energy to the liquid by generating heat or a piezoelectric element which applies energy to the liquid by deformation.

The discharge control circuit 102 controls the operation of the discharge element 101 by changing a voltage applied to the discharge element 101. The discharge control circuit 102 receives a driving signal from outside of the discharge unit 105. When the driving signal is at high level, the discharge control circuit 102 applies a voltage to the discharge element 101. In response to this voltage, the discharge element 101 applies energy to the liquid. Meanwhile, when the driving signal is at low level (for example, 0V), the discharge control circuit 102 applies no voltage to the discharge element 101. In this case, the discharge element 101 applies no energy to the liquid.

The voltage generation circuit 106 receives a reference voltage $V_{ref}$ input from outside of the liquid discharge head substrate 100 and a monitoring node voltage $V_m$ of the discharge control circuit 102. The monitoring node voltage $V_m$ is correlated with the voltage applied to the discharge element 101. Therefore, the voltage generation circuit 106 can check the voltage applied to the discharge element 101 by monitoring the voltage $V_m$. The reference voltage $V_{ref}$ is supplied, for example, from a liquid discharge apparatus to the liquid discharge head substrate 100.

The voltage generation circuit 106 generates a driving voltage $V_{FB}$ of the discharge control circuit 102 and supplies it to the discharge control circuit 102. The discharge control circuit 102 uses the driving voltage $V_{FB}$ as a driving power supply voltage. The discharge control circuit 102 determines, based on the driving voltage $V_{FB}$, the voltage to apply to the discharge element 101. Therefore, the voltage generation circuit 106 can control the amount of current flowing through the discharge element 101 by regulating the value of the driving voltage $V_{FB}$. More specifically, the voltage generation circuit 106 controls, or regulates, the value of the driving voltage $V_{FB}$ such that the monitoring voltage $V_m$ and the reference voltage $V_{ref}$ input from outside of the liquid discharge head substrate 100 become substantially equal to each other.

The voltage generation circuit 106 includes a comparison circuit 107 which compares the monitoring voltage $V_m$ and the reference voltage $V_{ref}$. The voltage generation circuit 106 controls, or regulates, the driving voltage $V_{FB}$ based on the comparison result of the comparison circuit 107 and supplies it to the discharge control circuit 102.

The effect of the liquid discharge head substrate 100 will now be described. When using a structure described in Japanese Patent Laid-Open No. 2010-155452, the characteristics of transistors in a circuit which drives a discharge element may vary, depending on the accuracy of a process when manufacturing a liquid discharge head substrate, among a plurality of liquid discharge head substrates obtained from different wafers or different chips. When the characteristics of these transistors vary, a voltage applied to the discharge element varies, and thus the amount of current flowing through the discharge element varies accordingly even if the same driving voltage is supplied to each transistor of the plurality of liquid discharge head substrates. As a result, a liquid discharge amount varies among the plurality of liquid discharge head substrates even if they are driven on the same condition.

To cope with this, the voltage generation circuit 106 of the liquid discharge head substrate 100 controls, or regulates, the value of the driving voltage $V_{FB}$ such that the monitoring voltage $V_m$ and the reference voltage $V_{ref}$ input from outside of the liquid discharge head substrate 100 become substantially equal to each other. Therefore, if the reference voltage $V_{ref}$ having a predetermined value is supplied to the plurality of liquid discharge head substrates 100, the monitoring voltage $V_m$ has a predetermined value among the plurality of liquid discharge head substrates 100 irrespective of the characteristics of the transistor in each liquid discharge head substrate 100. Since the monitoring voltage $V_m$ is correlated with the voltage applied to the discharge element 101, the currents flowing through the discharge elements 101 also become equal to each other among the plurality of liquid discharge head substrates. As a result, a variation in the liquid discharge amount is suppressed among the plurality of liquid discharge head substrates, increasing a manufacturing yield.

Figure 2:
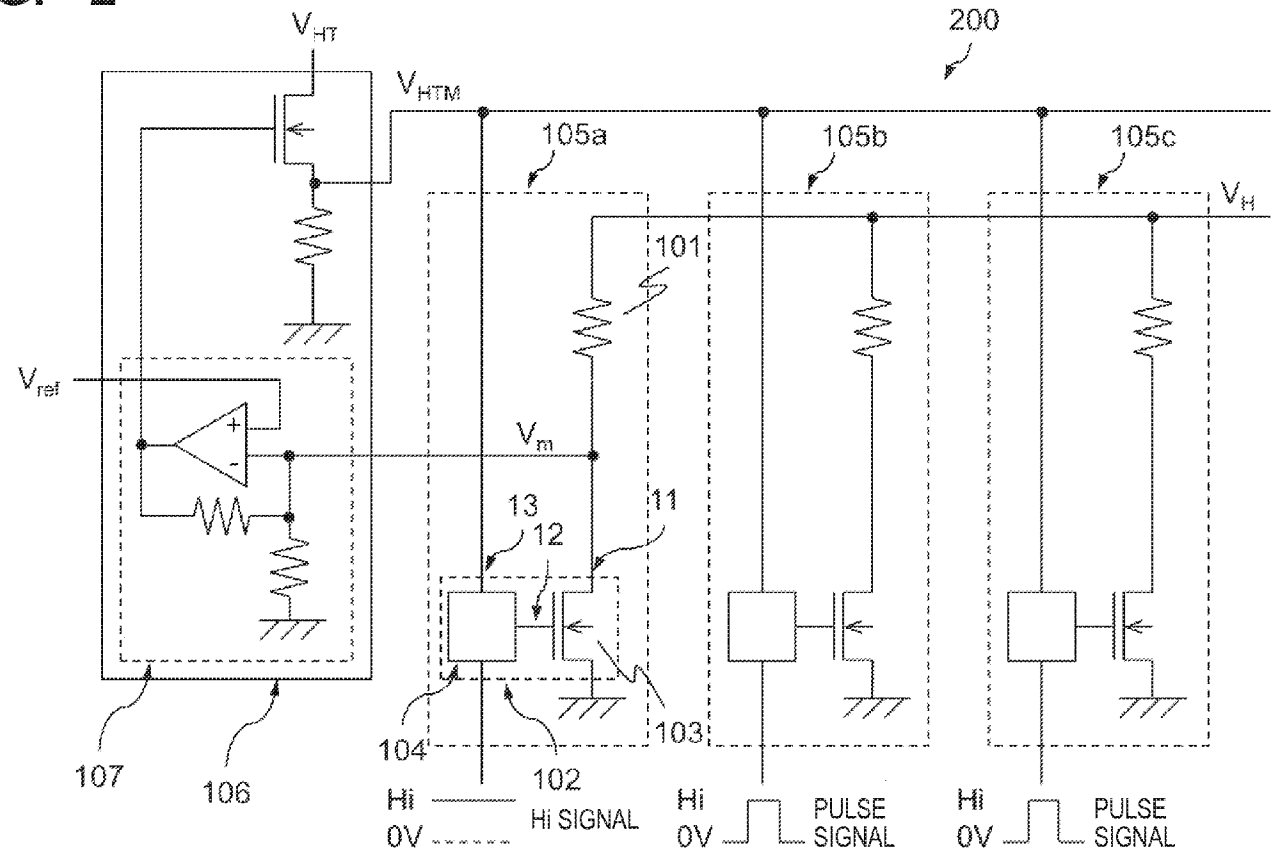
FIG. 2 is a circuit diagram showing the arrangement of the liquid discharge head substrate according to the embodiment of the present invention.

A liquid discharge head substrate 200 including an example of a circuit arrangement which implements the function of the liquid discharge head substrate 100 will now be described with reference to FIG. 2. FIG. 2 is a circuit diagram of the liquid discharge head substrate 200 according to this embodiment. In this embodiment, the liquid discharge head substrate 200 includes the plurality of discharge units 105. FIG. 2 shows, out of the plurality of discharge units 105, the three discharge units 105 which are indicated by 105*a*, 105*b*, and 105*c*, respectively.

First, the arrangement and the operation common to each of the discharge units 105*a* to 105*c* will be described. The discharge element 101 which generates energy for discharging the liquid is the heating element and represented as a resistor in the circuit diagram. The piezoelectric element may be used in place of the heating element. The same also applies to other embodiments to be described below. One terminal of the discharge element 101 is connected to a power supply $V_H$ and the other terminal is connected to the discharge control circuit 102. The discharge control circuit 102 includes a driving transistor 103 and a control circuit 104. In this embodiment, the driving transistor 103 is formed by, for example, an NMOS transistor. One main electrode of the driving transistor 103 is connected to the discharge element 101, the other main electrode is connected to ground, and the gate electrode serving as a control electrode is connected to the control circuit 104.

The control circuit 104 of the discharge control circuit 102 receives a driving voltage $V_{HTM}$ as the driving power supply voltage from the voltage generation circuit 106. The driving voltage $V_{HTM}$ corresponds to the driving voltage $V_{FB}$ in FIG. 1. The control circuit 104 also receives a driving signal for controlling the driving transistor 103 from outside of the liquid discharge head substrate 200. When this driving signal is at high level, the control circuit 104 controls to input the driving voltage $V_{HTM}$ to the gate electrode of the driving transistor 103. In this case, the driving transistor 103 is turned on. This passes the current through the discharge element 101. As a result, the discharge element 101 generates heat and discharges the liquid. When this driving signal is at 0V, the control circuit 104 controls not to input the driving voltage $V_{HTM}$ to the gate electrode of the driving transistor 103. Therefore, the driving transistor 103 is turned off and no current flows through the discharge element 101. A phenomenon in which the driving signal changes to high level and the driving transistor 103 which controls the voltage applied to the discharge element 101 is turned on, thereby operating the discharge element 101 is referred to as switching driving.

The arrangement unique to the discharge unit 105*a* will now be described. The discharge unit 105*a* outputs, as the monitoring voltage $V_m$, the voltage of a node 11 in the discharge control circuit 102 to the voltage generation circuit 106. The node 11 is a portion where the discharge element 101 and the driving transistor 103 are connected to each other. The voltage of the node 11 is correlated with the voltage applied to the discharge element 101.

In this embodiment, the comparison circuit 107 in the voltage generation circuit 106 is formed by, for example, an inverting amplifier circuit. The monitoring voltage $V_m$ is input from the discharge unit 105*a* to the inverting input terminal of the comparison circuit 107 and the reference voltage $V_{ref}$ is input from outside of the liquid discharge head substrate 200 to the non-inverting input terminal of the comparison circuit 107. The output from the comparison circuit 107 is fed back, as the driving voltage $V_{HTM}$, to each discharge unit 105 via the source follower circuit of the voltage generation circuit 106. One main electrode of this source follower circuit is connected to a power supply $V_{ET}$ and the other main electrode is connected to ground via the resistor. Since the voltage generation circuit 106 is arranged as described above, the driving voltage $V_{HTM}$ is supplied to the control circuit 104 of each discharge unit 105 such that the monitoring voltage $V_m$ becomes equal to the reference voltage $V_{ref}$.

The operation of the liquid discharge head substrate 200 will now be described. The discharge unit 105*a* is used as a monitoring unit configured to control the driving voltage $V_{HTM}$ to be supplied to each discharge unit 105. Each of the discharge units 105*b* and 105*c* is used as a liquid discharge unit configured to discharge a liquid corresponding to image data. In this embodiment, the discharge unit 105*a* is used only as the monitoring unit and does not discharge the liquid corresponding to the image data. When operating the liquid discharge head substrate 200, a Hi signal is supplied to the monitoring unit as a driving signal and a pulse signal is supplied to each liquid discharge unit as a driving signal. The Hi signal is always at high level irrespective of the image data. The pulse signal switches between high level and low level in accordance with the image data. In accordance with the image data, the pulse signal changes to high level in a case in which each discharge unit 105 should discharge the liquid and changes to low level (for example, 0V) in other cases. The discharge element 101 of the discharge unit 105*a* is always driven when operating the liquid discharge head substrate 200.

If the driving transistor 103 of the discharge unit 105*a* is ON, a current i1 flows through the discharge element 101 of the discharge unit 105*a*, a current i2 flows through the driving transistor 103, and a current i3 flows from the discharge unit 105*a* to the comparison circuit 107. In this case, i1=i2+i3 holds. The current i3 flowing through the comparison circuit 107 is much smaller than the currents i1 and i2. Therefore, the currents i1 and i2 become substantially equal to each other. Meanwhile, in the liquid discharge unit (for example, the discharge unit 105*b*), the current flowing through the discharge element 101 and the current flowing through the driving transistor 103 become equal to each other if the driving transistor 103 is ON. Variations in the characteristics of the respective elements in the plurality of adjacent discharge units 105 are smaller than those between the wafers or the chips, and thus can be ignored. Therefore, if the common driving voltage $V_{HTM}$ is input to the respective discharge control circuits 102 of the discharge unit 105*a* and the discharge unit 105*b*, the currents flowing through the respective driving transistors 103 of the discharge unit 105*a* and the discharge unit 105*b* become equal to each other. Therefore, it can be regarded that the current flowing through the discharge element 101 of the discharge unit 105*a* and the current flowing through the discharge element 101 of the discharge unit 105*b* are equal to each other. Therefore, as in this embodiment, if the driving voltage $V_{HTM}$ based on the node 11 in the one discharge unit 105*a* is supplied to the plurality of discharge units 105*a* to 105*c*, variations in the currents flowing through the discharge elements 101 of the respective discharge units 105*a* to 105*c* can be ignored.

The discharge element 101 is operated by switching driving in the liquid discharge head substrate 200. However, an arrangement in which, for example, the driving transistor 103 is formed by a PMOS transistor and driven as a source follower circuit may be adopted. In this case, the driving voltage $V_{HTM}$ has a value decreased by a voltage between the gate and source of the driving transistor 103 from a voltage of the node which connects the discharge element 101 and the driving transistor 103 of the discharge unit 105*a*. Further, in this embodiment, the driving transistor 103 is arranged between the discharge element 101 and ground. However, the driving transistor 103 may be arranged between, for example, the discharge element 101 and the power supply $V_H$.

Figure 3:
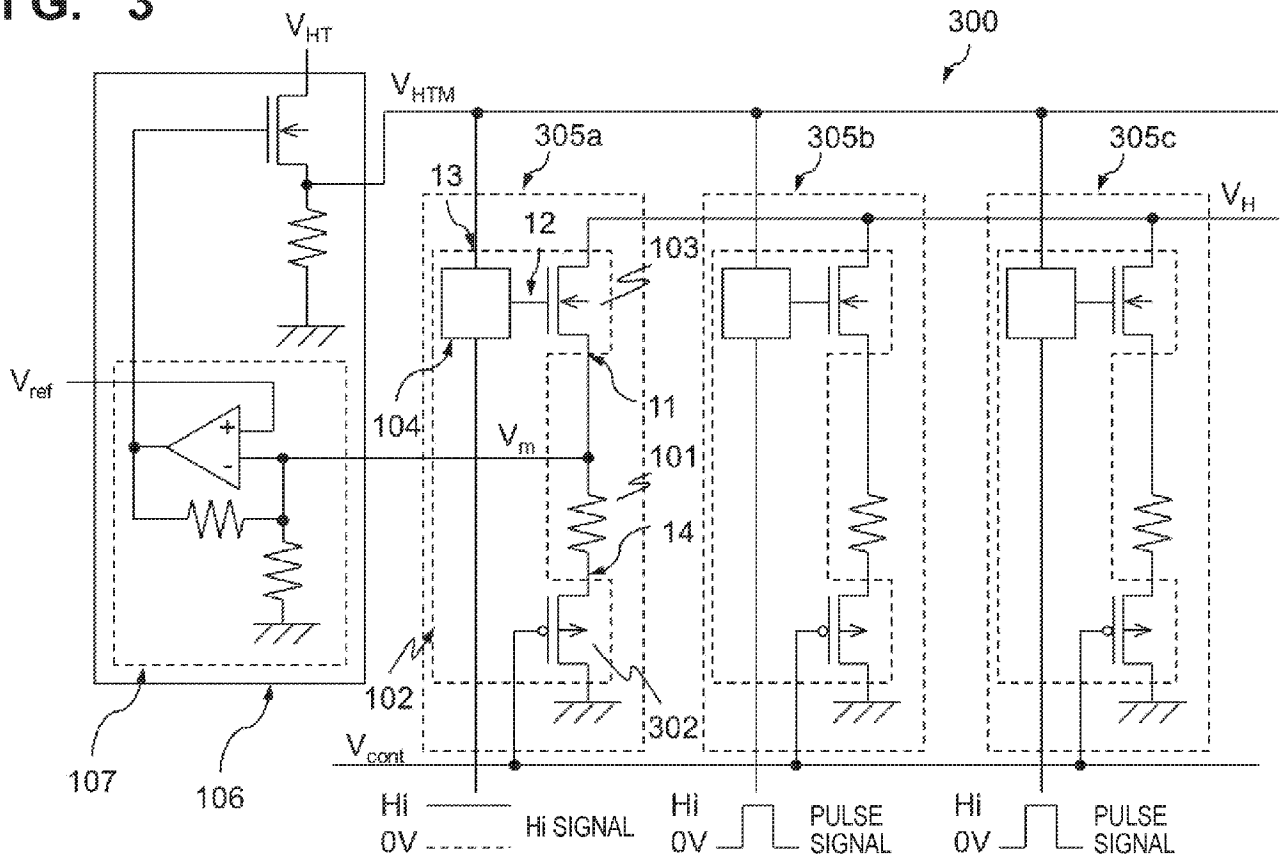
FIG. 3 is a circuit diagram showing the arrangement of the liquid discharge head substrate according to the embodiment of the present invention.

Furthermore, the case in which the liquid discharge head substrate 200 includes one driving transistor of the discharge control circuit 102 which controls the discharge element 101 has been described. However, the discharge control circuit 102 may be formed by two driving transistors. In this embodiment, FIG. 3 is a circuit diagram showing the arrangement of a liquid discharge head substrate 300 when forming the discharge control circuit 102 by the two driving transistors. The liquid discharge head substrate 300 includes the voltage generation circuit 106 and a plurality of discharge units 305.

The driving transistor of each discharge unit 305 is formed by two MOS transistors, namely, the driving transistor 103 using the NMOS transistor and a driving transistor 302 using the PMOS transistor. Each transistor forms a source follower circuit. One terminal of the discharge element 101 is connected to the source of the driving transistor 103. The other terminal of the discharge element 101 is connected to the source of the driving transistor 302. The drain of the driving transistor 103 is connected to the power supply $V_H$. The drain of the driving transistor 302 is connected to ground.

The gate electrode of the driving transistor 302 receives a constant voltage $V_{cont}$. In this case, a voltage increased by a voltage between the gate and source of the driving transistor 302 from the constant voltage $V_{cont}$ is applied to a node 14 between the discharge element 101 and the driving transistor 302. The control circuit 104 is connected to the gate electrode of the driving transistor 103. The control circuit 104 receives the driving voltage $V_{HTM}$ and the driving signal for controlling the driving transistor 103. In this case, a voltage decreased by the voltage between the gate and source of the driving transistor 103 from the driving voltage $V_{HTM}$ is applied to the node 11 between the discharge element 101 and the driving transistor 103.

The voltage generation circuit 106 of the liquid discharge head substrate 300 also controls, or regulates, the driving voltage $V_{HTM}$ such that the monitoring voltage $V_m$ and the reference voltage $V_{ref}$ supplied from outside of the liquid discharge head substrate 300 become equal to each other. As a result, a voltage across the discharge element 101 of each discharge unit 305 is determined not by the characteristics of the transistors but by the reference voltage $V_{ref}$ and the constant voltage $V_{cont}$. Therefore, variations in the voltages applied to the discharge elements 101 among the plurality of liquid discharge head substrates 300 are suppressed. This makes it possible to obtain, in the liquid discharge head substrate 300 using the two driving transistors for the discharge control circuit 102, the same effect as in the liquid discharge head substrate 200.

In this embodiment, the liquid discharge head substrate 300 adopts the arrangement in which each driving transistor is operated by using the source follower circuit. However, the present invention is not limited to this. The liquid discharge head substrate 300 may adopt, for example, an arrangement in which the two driving transistors undergo switching driving or an arrangement in which driving by the source follower circuit and switching driving are combined.

Furthermore, in this embodiment, the monitoring voltage $V_m$ monitors the voltage of the node 11 which connects the discharge elements 101 of the discharge units 105*a* and 305*a*, and the driving transistor 103. However, the present invention is not limited to this. For example, the voltage of a node 12 which connects the driving transistor 103 and the control circuit 104 or a node 13 which connects the voltage generation circuit 106 and the discharge control circuit 102 may be input, as the monitoring voltage $V_m$, to the comparison circuit 107 of the voltage generation circuit 106. Both the voltages of the node 12 and the node 13 are correlated with the voltage applied to the discharge element 101. In either case, the voltage generation circuit 106 controls, or regulates, the driving voltage $V_{HTM}$ such that the monitoring voltage $V_m$ becomes equal to the reference voltage $V_{ref}$. If each of the discharge units 105*a* and 305*a* only functions as the monitoring unit, the discharge unit may not include the control circuit 104. In this case, the driving voltage $V_{HTM}$ is directly input to the gate electrode of the driving transistor 103. Therefore, the driving transistor 103 is always driven when operating the liquid discharge head substrates 200 and 300 even if the monitoring unit does not receive the driving signal. In this embodiment, the comparison circuit 107 uses the inverting amplifier circuit. However, any circuit arrangement may be adopted as long as feedback of the voltage generation circuit 106 functions so as to equalize the monitoring voltage $V_m$ and the reference voltage $V_{ref}$ with each other.

Figure 4:
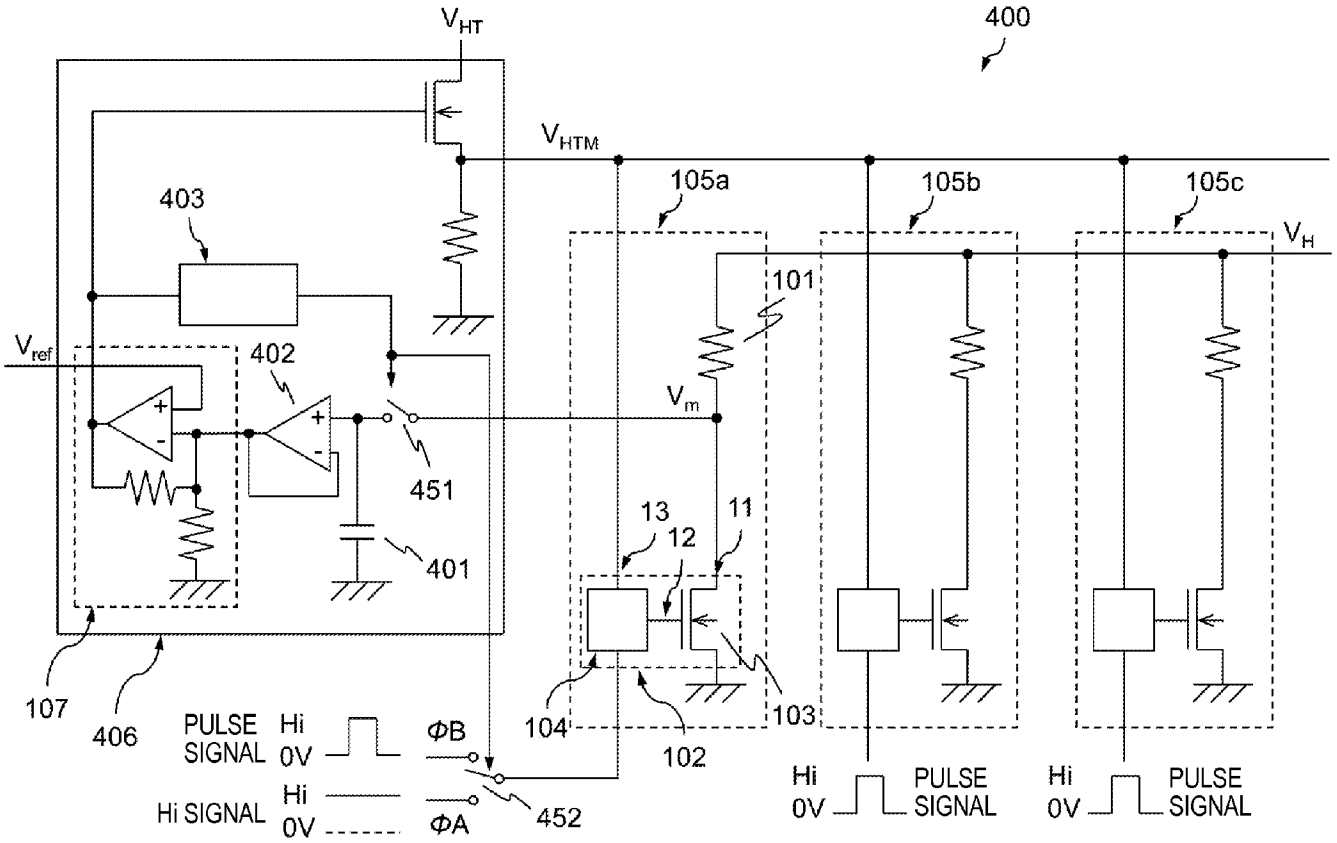
FIG. 4 is a circuit diagram showing the arrangement of the liquid discharge head substrate according to another embodiment of the present invention.
Figure 5:
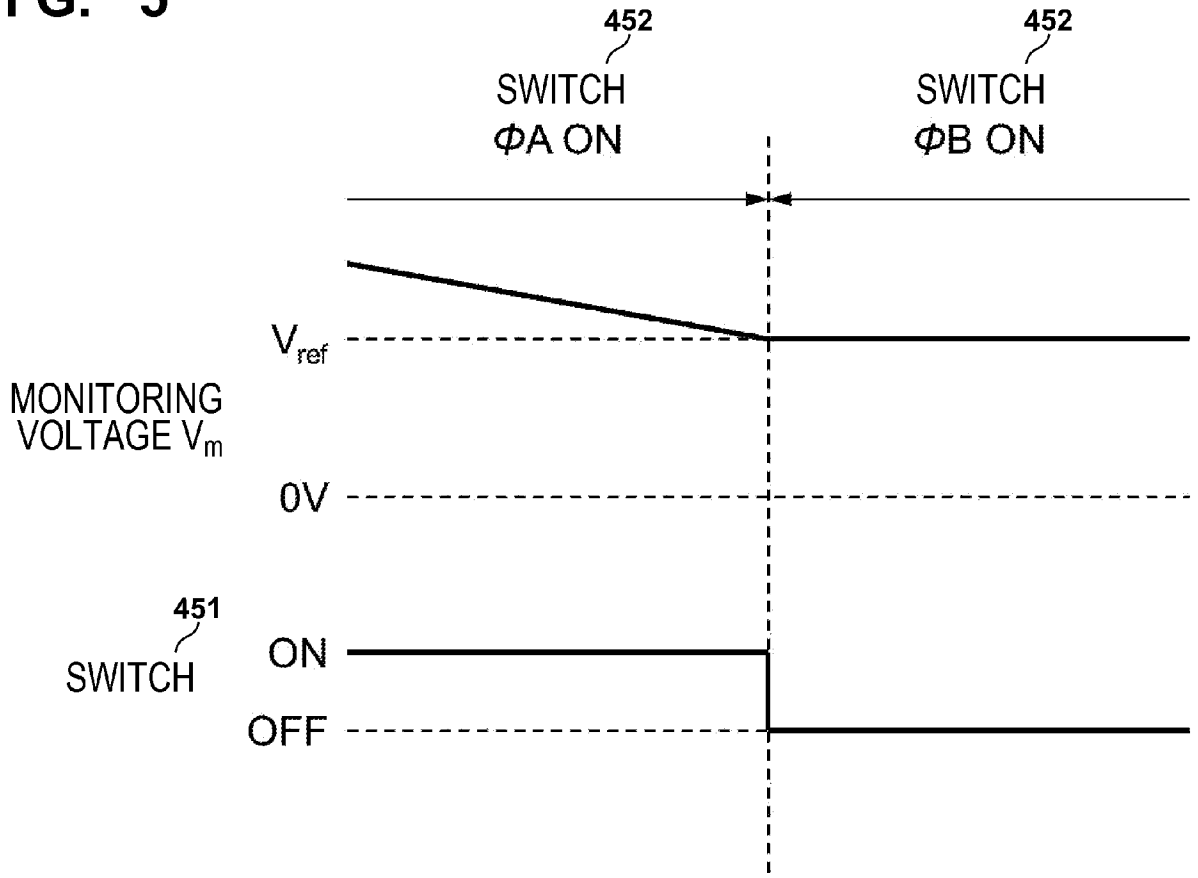
FIG. 5 is a chart for explaining the operation of the liquid discharge head substrate in FIG. 4.

The arrangement and the operation of a liquid discharge head substrate 400 including another example of a circuit arrangement which implements the function of the liquid discharge head substrate 100 will be described with reference to FIGS. 4 and 5. FIG. 4 is a circuit diagram showing the arrangement of the liquid discharge head substrate 400 according to this embodiment. The liquid discharge head substrate 400 can be the same as the liquid discharge head substrate 200 except that an arrangement of a voltage generation circuit and a switch 452 are included. Therefore, a repetitive description on the components similar to those of the liquid discharge head substrate 200 will be omitted.

In the liquid discharge head substrate 400, a switch 451 and a buffer circuit 402 are connected in series between the inverting input terminal of a comparison circuit 107 and a node 11 of a discharge unit 105*a*. A node which connects the buffer circuit 402 and the switch 451 is connected to ground via a holding capacitor 401. The switch 452 is provided in order to switch between two signals, namely, a monitoring Hi signal and a pulse signal corresponding to the image data, and input the signal to a control circuit 104 of a discharge control circuit 102. The switch 452 connects the control circuit 104 to either a terminal ϕA or a terminal ϕB. A control block 403 is connected to the output portion of the comparison circuit 107. The control block 403 controls the switch 451 and the switch 452. Compared to the voltage generation circuit 106, a voltage generation circuit 406 further includes the holding capacitor 401, the buffer circuit 402, the control block 403, and the switch 451, and forms a sample-and-hold circuit.

The operation of the liquid discharge head substrate 400 according to this embodiment will now be described with reference to FIG. 5. FIG. 5 is a timing chart showing the operation of the liquid discharge head substrate 400 according to this embodiment. First, a case in which the discharge unit 105*a* is used as the monitoring unit configured to control the driving voltage $V_{HTM}$ to be supplied to each discharge unit 105 will be described. The control block 403 turns on the switch 451 to electrically connect the discharge unit 105*a* with the holding capacitor 401 and the buffer circuit 402. In this case, the monitoring voltage $V_m$ is input from the discharge unit 105*a* via the buffer circuit 402 to the inverting input terminal of the comparison circuit 107. Also, the monitoring voltage $V_m$ is held in the holding capacitor 401. The control block 403 turns on the switch 451 and connects the switch 452 to the terminal ϕA. This inputs the Hi signal, as a driving signal, to the control circuit 104 of the discharge unit 105*a*. Therefore, the discharge unit 105*a* is turned on and operates as the monitoring unit configured to monitor the node of the discharge control circuit 102. As a result, the voltage generation circuit 406 controls, or regulates, the driving voltage $V_{HTM}$ such that the monitoring voltage $V_m$ becomes equal to the reference voltage $V_{ref}$ applied from outside of the liquid discharge head substrate 400, and supplies the regulated voltage to the control circuit 104 of each discharge unit.

A case in which the discharge unit 105*a* is used as a liquid discharge unit for discharging the liquid will now be described. When the monitoring voltage $V_m$ becomes equal to the reference voltage $V_{ref}$, the control block 403 turns off the switch 451. This opens between the discharge unit 105*a*, and the holding capacitor 401 and the buffer circuit 402. The control block 403 turns off the switch 451 and connects the switch 452 to the terminal ϕB. Consequently, the pulse signal corresponding to the image data is input, as the driving signal, to the control circuit 104 of the discharge unit 105*a*, and the discharge unit 105*a* functions as the liquid discharge unit which discharges the liquid corresponding to the image data. In this case, the monitoring voltage $V_m$ equal to the reference voltage $V_{ref}$ and held in the holding capacitor 401 is input to the inverting input terminal of the comparison circuit 107 via the buffer circuit 402.

When using the discharge unit 105*a* as the liquid discharge unit, a current i3 does not flow from the discharge unit 105*a* to the comparison circuit 107 because the switch 451 is OFF. Therefore, a current i1 flowing through a discharge element 101 of the discharge unit 105*a* becomes equal to a current i2 flowing through the driving transistor 103. As a result, in each discharge unit 105, a voltage controlled by the reference voltage $V_{ref}$ is applied to the discharge element 101 when discharging the liquid, making the current i2 flow. This makes it possible to obtain, in the liquid discharge head substrate 400, the same effect as in the liquid discharge head substrate 200.

In this embodiment, the pulse signal is input to the terminal ϕB of the switch 452. However, an arrangement in which, for example, a 0V-signal is input and the discharge unit 105*a* only operates as the monitoring unit may be adopted. When the monitoring voltage $V_m$ becomes equal to the reference voltage $V_{ref}$, the control block 403 connects the switch 452 to the terminal ϕB. In this case, the 0V-signal is input, as the driving signal, to the control circuit 104 of the discharge unit 105*a*. This turns off the driving transistor 103, and the power consumption can be reduced because no current flows through the discharge element 101. While the switch 452 is connected to the terminal ϕB, the driving voltage $V_{HTM}$ obtained when the monitoring voltage $V_m$ and the reference voltage $V_{ref}$ become equal to each other is supplied to the control circuit 104 of each discharge unit other than the discharge unit 105*a*.

For example, the switch 452 may have three states, and switch among three signals, namely, the pulse signal, the Hi signal, and the 0V-signal as needed to input the signal to the control circuit 104 of the discharge unit 105*a*. This allows the discharge unit 305*a* to function as the liquid discharge unit and the monitoring unit which reduces the power consumption, respectively.

In this embodiment, the monitoring voltage $V_m$ monitors the voltage of the node 11. However, for example, the voltage of a node 12 or a node 13 may be input to the comparison circuit 107 as the monitoring voltage $V_m$, as described above.

Figure 6:
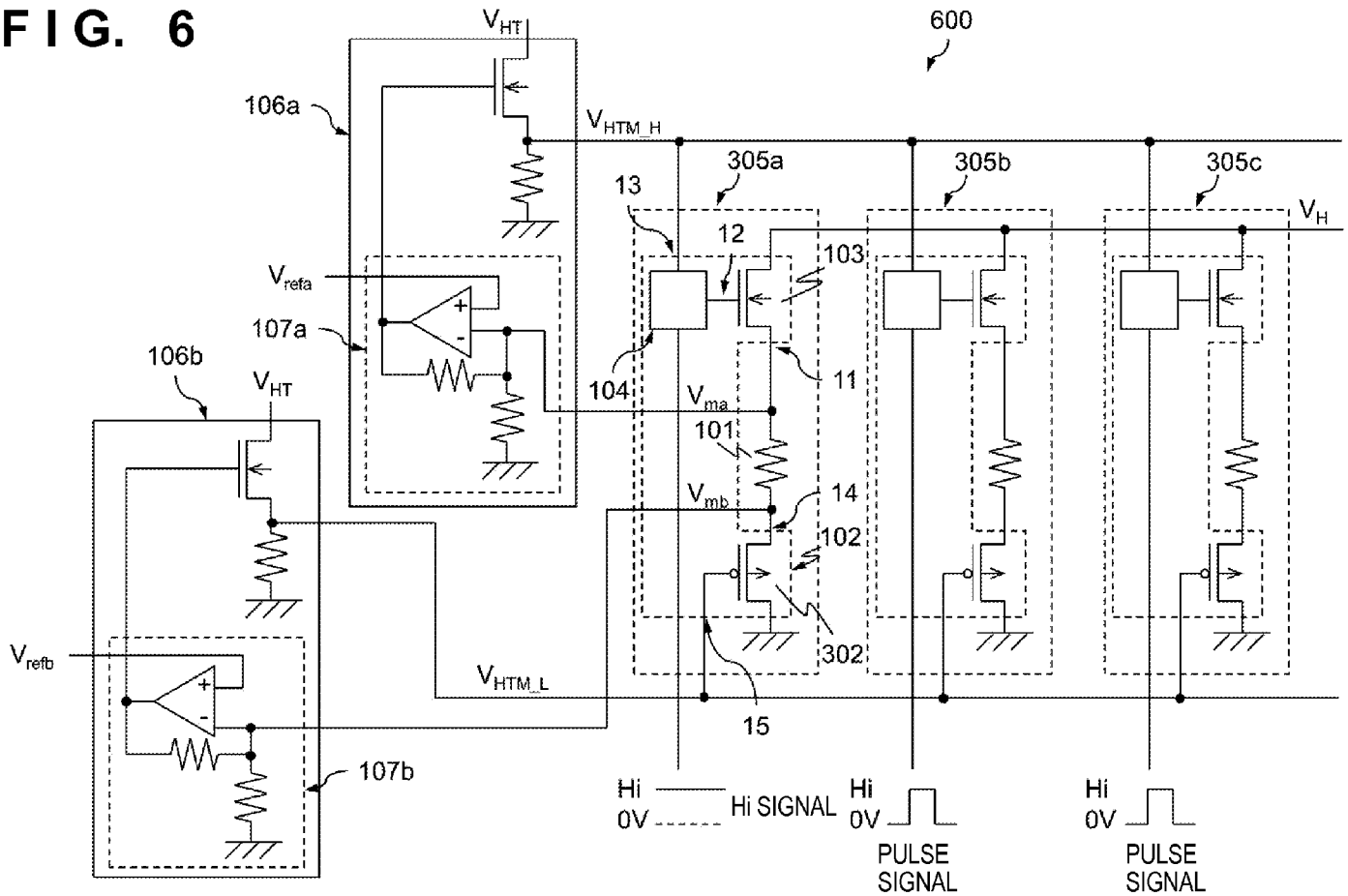
FIG. 6 is a circuit diagram showing the arrangement of the liquid discharge head substrate according to still another embodiment of the present invention.

The arrangement and the operation of a liquid discharge head substrate 600 having another example of a circuit arrangement which implements the function of the liquid discharge head substrate 100 will be described with reference to FIG. 6. FIG. 6 is a circuit diagram showing the arrangement of the liquid discharge head substrate 600 according to this embodiment. The liquid discharge head substrate 600 can be the same as the liquid discharge head substrate 300 except that two voltage generation circuits are included, namely, a voltage generation circuit 106*a* and a voltage generation circuit 106*b*. Therefore, a repetitive description on the components similar to those of the liquid discharge head substrate 300 will be omitted.

A comparison circuit 107*a* of the voltage generation circuit 106*a* receives a monitoring voltage $V_{ma}$ which monitors a node 11 of a discharge control circuit 102 in a discharge unit 305*a* and a reference voltage $V_{refa}$ applied from outside of the liquid discharge head substrate 600. A comparison circuit 107*b* of the voltage generation circuit 106*b* receives a monitoring voltage $V_{mb}$ which monitors a node 14 of the discharge unit 305*a* and a reference voltage $V_{refb}$ applied from outside of the liquid discharge head substrate 600.

The driving transistor in each discharge unit 305 is formed by two transistors, namely, a driving transistor 103 serving as an NMOS transistor and a driving transistor 302 serving as a PMOS transistor. Each transistor forms a source follower circuit. One terminal of a discharge element 101 is connected to the source of the driving transistor 103. The other terminal of the discharge element 101 is connected to the source of the driving transistor 302. The drain of the driving transistor 103 is connected to a power supply $V_H$. The drain of the driving transistor 302 is connected to ground.

The operation of the liquid discharge head substrate 600 will now be described. The voltage generation circuit 106*a* controls, or regulates, a driving voltage $V_{HTM_H}$ such that the monitoring voltage $V_{ma}$ becomes equal to the reference voltage $V_{refa}$, and then outputs the regulated voltage. The voltage generation circuit 106*b* controls, or regulates, a driving voltage $V_{HTM_L}$ such that the monitoring voltage $V_{mb}$ becomes equal to the reference voltage $V_{refb}$, and then outputs the regulated voltage.

A control circuit 104 is connected to the gate electrode of the driving transistor 103. The control circuit 104 receives the driving voltage $V_{HTM_H}$ and a driving signal for controlling the driving transistor 103 from outside of the liquid discharge head substrate 600. The driving voltage $V_{HTM_H}$ is input to the gate electrode of the driving transistor 302. The monitoring voltages $V_{ma}$ and $V_{mb}$, the reference voltages $V_{refa}$ and $V_{refb}$, and the driving voltages $V_{HTM_H}$ and $V_{HTM_L}$, respectively, have different values. In this embodiment, assume that $V_{ma}>V_{mb}$, $V_{refa}>V_{refb}$, and $V_{HTM_H}>V_{HTM_L}$ are satisfied.

The voltage generation circuit 106*a* of the liquid discharge head substrate 600 also controls, or regulates, the driving voltage $V_{HTM_H}$ such that the monitoring voltage $V_{ma}$ and the reference voltage $V_{refa}$ supplied from outside of the liquid discharge head substrate 600 become equal to each other. The voltage generation circuit 106*b* of the liquid discharge head substrate 600 also controls, or regulates, the driving voltage $V_{HTM_L}$ such that the monitoring voltage $V_{mb}$ and the reference voltage $V_{refb}$ supplied from outside of the liquid discharge head substrate 600 become equal to each other. As a result, a voltage across the discharge element 101 of each discharge unit 305 is determined by the reference voltage $V_{refa}$ and the reference voltage $V_{refb}$. Therefore, variations in the voltages applied to the discharge elements 101 among the plurality of liquid discharge head substrates 600 are suppressed. This makes it possible to obtain, in the liquid discharge head substrate 600, the same effect as in the liquid discharge head substrate 300.

In the liquid discharge head substrate 600 according to this embodiment, the two driving transistors control the voltages of the nodes in the two terminals of the discharge element 101. Furthermore, both of the two driving transistors are controlled by a feedback circuit. This further stabilizes the voltages applied to the two terminals of the discharge element 101 as compared with a case in which only the voltage of the node in one terminal of the discharge element 101 is controlled. As a result, variations in the voltages applied to the discharge element 101 can further be suppressed.

In this embodiment, the voltage of the node 11 is used as the monitoring voltage $V_{ma}$. However, for example, the voltage of a node 12 or a node 13 may be input to the comparison circuit 107*a* as the monitoring voltage $V_{ma}$, as described above. Also, the voltage of a node 15 which connects, for example, the voltage generation circuit 106*b* and the discharge control circuit 102 may be input, as the monitoring voltage $V_{mb}$, to the comparison circuit 107*b*. The nodes which monitor the monitoring voltage $V_{ma}$ and the monitoring voltage $V_{mb}$ may be in any combination. Furthermore, the voltages of the nodes in the two terminals of the discharge element 101 may be monitored.

Figure 7:
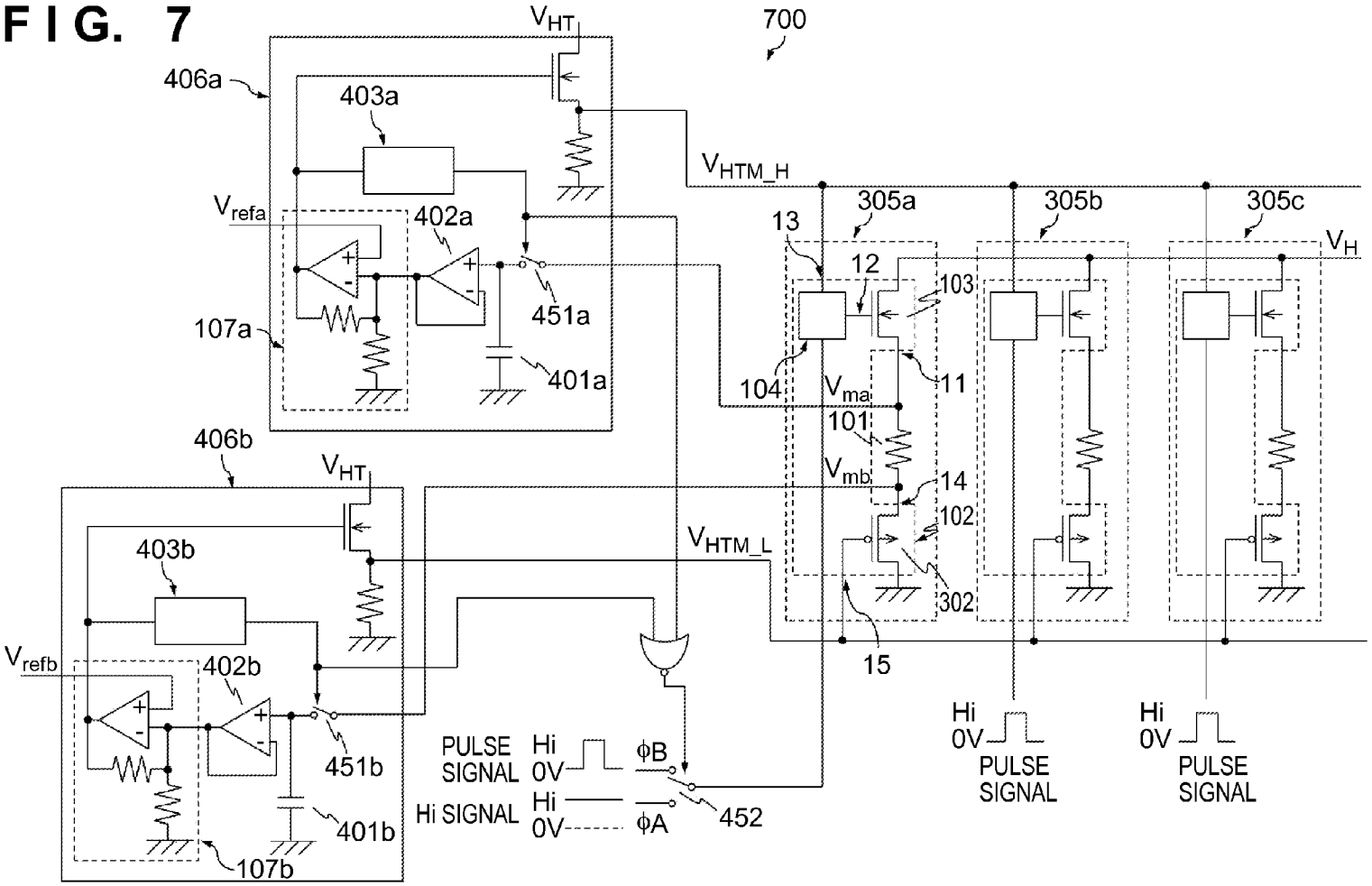
FIG. 7 is a circuit diagram showing the arrangement of the liquid discharge head substrate according to still another embodiment of the present invention.

The arrangement and the operation of a liquid discharge head substrate 700 including another example of a circuit arrangement which implements the function of the liquid discharge head substrate 100 will be described with reference to FIG. 7. FIG. 7 is a circuit diagram showing the arrangement of the liquid discharge head substrate 700 according to this embodiment. The liquid discharge head substrate 700 can be the same as the liquid discharge head substrate 600 except that the voltage generation circuit 106 is changed to the voltage generation circuit 406 described in the liquid discharge head substrate 400 and a switch 452 is included. Therefore, a repetitive description on the components similar to those of the liquid discharge head substrates 400 and 600 will be omitted.

In the liquid discharge head substrate 700, a switch 451*a* and a buffer circuit 402*a* are connected in series between the inverting input terminal of a comparison circuit 107*a* and a node 11 of a discharge unit 305*a*. A node which connects a buffer circuit 402*a* and the switch 451*a* is connected to ground via a holding capacitor 401*a*. A reference voltage $V_{refa}$ is input from outside of the liquid discharge head substrate 700 to the non-inverting input terminal of the comparison circuit 107*a*. A switch 451*b* and a buffer circuit 402*b* are connected in series between the inverting input terminal of a comparison circuit 107*b* and a node 14 of the discharge unit 305*a*. A node which connects the buffer circuit 402*b* and the switch 451*b* is connected to ground via a holding capacitor 401*b*. A reference voltage $V_{refb}$ is input from outside of the liquid discharge head substrate 700 to the non-inverting input terminal of the comparison circuit 107*b*.

A control block 403*a* of a voltage generation circuit 406*a* controls the switch 451*a*. A control block 403*b* of a voltage generation circuit 406*b* controls the switch 451*b*. The switch 452 is provided in order to switch between two driving signals, namely, a monitoring Hi signal and a pulse signal corresponding to the image data, and input the signal to a control circuit 104 of a discharge control circuit 102. The signals from the control blocks 403*a* and 403*b* are transmitted to this switch 452 via, for example, a NOR circuit.

The operation of the liquid discharge head substrate 700 will now be described. First, a case in which the discharge unit 305*a* is used as a monitoring unit configured to control the driving voltages $V_{HTM_H}$ and $V_{HTM_L}$ to be supplied to each discharge unit 105 will be described. The control blocks 403*a* and 403*b* turn on the switches 451*a* and 451*b* to electrically connect the discharge unit 305*a* with the holding capacitors 401*a* and 401*b* and the buffer circuits 402*a* and 402*b*. In this case, the monitoring voltages $V_{ma}$ and $V_{mb}$ are input to the inverting input terminals of the comparison circuits 107*a* and 107*b* via the buffer circuits 402*a* and 402*b*. In this case, the monitoring voltage $V_{ma}$ is held in the holding capacitor 401*a* and the monitoring voltage $V_{mb}$ is held in the holding capacitor 401*b*. Also, the switch 452 is connected to a terminal ϕA in this case. This inputs the Hi signal, as the driving signal, to the control circuit 104 of the discharge unit 305*a*. Therefore, the discharge unit 305*a* is turned on and operates as the monitoring unit configured to monitor the node. The voltage generation circuit 406*a* controls, or regulates, the driving voltage $V_{HTM_H}$ such that the monitoring voltage $V_{ma}$ becomes equal to the reference voltage $V_{refa}$, and supplies it to the control circuit 104 of each discharge unit. The voltage generation circuit 406*b* controls, or regulates, the driving voltage $V_{HTM_L}$ such that the monitoring voltage $V_{mb}$ becomes equal to the reference voltage $V_{refb}$, and supplies it to the gate electrode of the driving transistor 302.

A case in which the discharge unit 105*a* is used as the liquid discharge unit for discharging the liquid corresponding to the image data will now be described. When the monitoring voltages $V_{ma}$ and $V_{mb}$ become equal to the reference voltages $V_{refa}$ and $V_{refb}$ respectively, the control blocks 403*a* and 403*b* respectively turn off the switch 451*a* and the switch 451*b*. Control signals from the control blocks 403*a* and 403*b* turn off the switch 451*a* and the switch 451*b*, and connect the switch 452 to a terminal ϕB by a signal switching circuit using a NOR circuit. This inputs, as the driving signal, the pulse signal corresponding to the image data to the control circuit 104 of the discharge unit 305*a*, and the discharge unit 305*a* functions as the liquid discharge unit which discharges the liquid corresponding to the image data. In this case, the monitoring voltages $V_{ma}$ and $V_{mb}$ equal to the reference voltages $V_{refa}$ and $V_{refb}$ and held in the holding capacitors 401*a* and 401*b* are input, via the buffer circuits 402*a* and 402*b*, to the inverting input terminals of the comparison circuits 107*a* and 107*b*. Since the control circuit 104 of the discharge unit 305*a* receives the pulse signal, the driving voltage $V_{HTM_H}$ is input to the gate electrode of the driving transistor 103 when the pulse signal changes to Hi. The driving voltage $V_{HTM_L}$ is input to the gate electrode of the driving transistor 302.

The voltage generation circuit 406*a* of the liquid discharge head substrate 700 also controls, or regulates, the driving voltage $V_{HTM_H}$ such that the monitoring voltage $V_{ma}$ and the reference voltage $V_{refa}$ supplied from outside of the liquid discharge head substrate 700 become equal to each other. The voltage generation circuit 406*b* of the liquid discharge head substrate 700 also controls, or regulates, the driving voltage $V_{HTM_L}$ such that the monitoring voltage $V_{mb}$ and the reference voltage $V_{refb}$ supplied from outside of the liquid discharge head substrate 700 become equal to each other. Since the switch 451*a* and the switch 451*b* are OFF, a current i3 does not flow from the discharge unit 305*a* to the comparison circuits 107*a* and 107*b*. Therefore, a current i2 flowing through a discharge element 101 has a predetermined value among the respective discharge units 305. As a result, in the discharge element 101 of each discharge unit 305, a voltage across the discharge element 101 when discharging the liquid is determined by the reference voltage $V_{refa}$ and the reference voltage $V_{refb}$. Therefore, variations in the voltages applied to the discharge elements 101 among the plurality of liquid discharge head substrates 700 are suppressed. This makes it possible to obtain, in the liquid discharge head substrate 700, an effect obtained by combining the liquid discharge head substrate 400 and the liquid discharge head substrate 600.

The four embodiments according to the present invention have been described above. However, the present invention is not limited to these embodiments. In the liquid discharge head substrate using, for example, two driving transistors, the voltage generation circuit 406 may be used as the voltage generation circuit and the voltage generation circuit 106 may be used as the voltage generation circuit. The respective embodiments described above can be changed and combined as needed.

An embodiment of a printing apparatus according to the present invention will be described. An inkjet printing apparatus will be described. A liquid discharge head serving as the printhead of the inkjet printing apparatus includes an inkjet printhead substrate and a liquid supply unit configured to supply ink to the inkjet printhead substrate. The liquid discharge head substrate described in the above-described embodiment can be used as the inkjet printhead substrate. The printing apparatus includes this printhead and a driving unit configured to control this printhead.

Figure 8A:
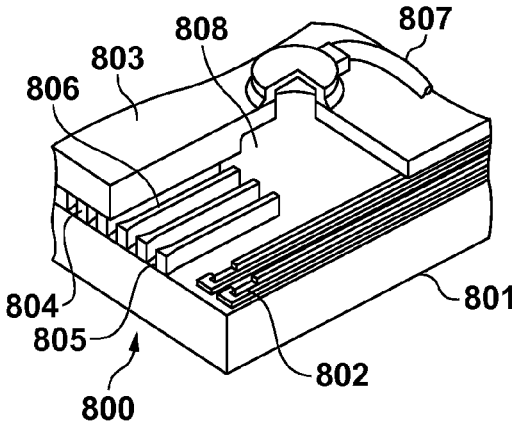
FIGS. 8A to 8D are views showing the arrangements of a liquid discharge head, a printing apparatus, and the control circuit of the printing apparatus.

FIG. 8A shows the main units of a printhead unit 800 including an inkjet printhead substrate 801 as described above. The printhead unit 800 includes an ink supply port 807. The discharge element 101 according to the embodiments of the present invention is illustrated as heating units 802. As shown in FIG. 8A, the substrate 801 can form the printhead unit 800 by assembling channel wall members 806 for forming fluid channels 805 communicating with a plurality of orifices 804, and a top plate 803 including the ink supply port 807. In this case, ink injected from the ink supply port 807 is stored in an internal common ink chamber 808, and then supplied to each fluid channel 805. In this state, the substrate 801 and the heating units 802 are driven to discharge ink from the orifices 804.

Figure 8B:
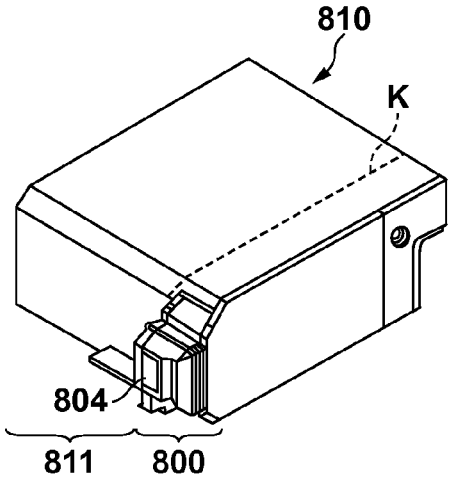

FIG. 8B is a view showing the overall arrangement of such a printhead 810. The printhead 810 includes the printhead unit 800 including the plurality of orifices 804 described above and an ink tank 811 which holds ink to be supplied to this printhead unit 800. The ink tank 811 is provided detachably from the printhead unit 800 with respect to a boundary line K. The printhead 810 includes an electrical contact (not shown) for receiving an electrical signal from a carriage side when mounted on the printing apparatus shown in FIG. 8C. The heating units 802 generate heat based on this electrical signal. Fibrous or porous ink absorbers are provided inside of the ink tank 811 to hold ink.

It is possible to provide the inkjet printing apparatus capable of achieving high-speed printing and high-resolution printing by attaching the printhead 810 shown in FIG. 8B to the main body of the inkjet printing apparatus and controlling a signal given from the main body to the printhead 810. The inkjet printing apparatus using such a printhead 810 will be described below.

Figure 8C:
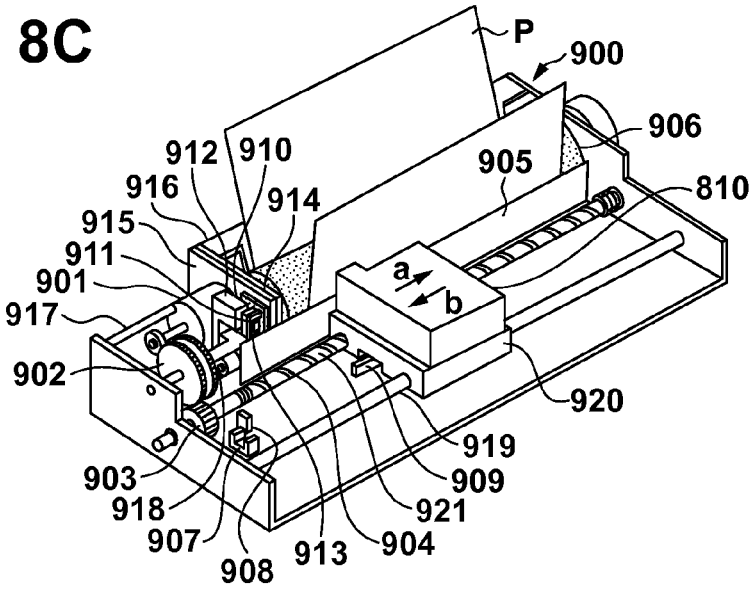

FIG. 8C is a perspective view showing the outer appearance of an inkjet printing apparatus 900 according to the embodiments of the present invention. In FIG. 8C, the printhead 810 is mounted on a carriage 920 which is engaged with a helical groove 921 of a lead screw 904 rotating in synchronism with forward/reverse rotation of a driving motor 901 via driving force transfer gears 902 and 903. With this arrangement, the printhead 810 can reciprocally move, by the driving force of the driving motor 901, in the direction of an arrow a or b along a guide 919 together with the carriage 920. A paper pressing plate 905 for a printing sheet P conveyed onto a platen 906 by a printing medium feeding apparatus (not shown) presses the printing sheet P against the platen 906 in the carriage moving direction.

Photocouplers 907 and 908 are home position detection units configured to confirm the existence of a lever 909 provided in the carriage 920 in a region where the photocouplers 907 and 908 are provided, and perform, for example, switching of the rotation direction of the driving motor 901. A support member 910 supports a cap member 911 which caps the entire surface of the printhead 810. A suction unit 912 sucks the inside of the cap member 911 and performs suction recovery of the printhead 810 via an intra-cap opening 913. A moving member 915 can move a cleaning blade 914 forward and backward. A main body support plate 916 supports the cleaning blade 914 and the moving member 915. Not only the cleaning blade 914 shown in FIG. 8C but also a known cleaning blade can be applied to this embodiment, as a matter of course. Furthermore, a lever 917 is arranged to start sucking in suction recovery and moves along with movement of a cam 918 engaged with the carriage 920, and a driving force from the driving motor 901 undergoes movement control such as clutch switching by a known transfer unit. A printing control unit (not shown) which gives signals to the heating units 802 provided in the printhead unit 800 or performs driving control of each mechanism of the driving motor 901 or the like is provided on the side of an apparatus main body.

The inkjet printing apparatus 900 having the above-described arrangement performs printing on the printing sheet P conveyed onto the platen 906 by the printing medium feeding apparatus while the printhead 810 reciprocally moves over the full width of the printing sheet P. The printhead unit 800 of the printhead 810 uses the inkjet printhead substrate serving as the liquid discharge head substrate according to the above-described embodiments. Therefore, the printhead unit 800 is compact and can achieve high-speed printing.

Figure 8D:
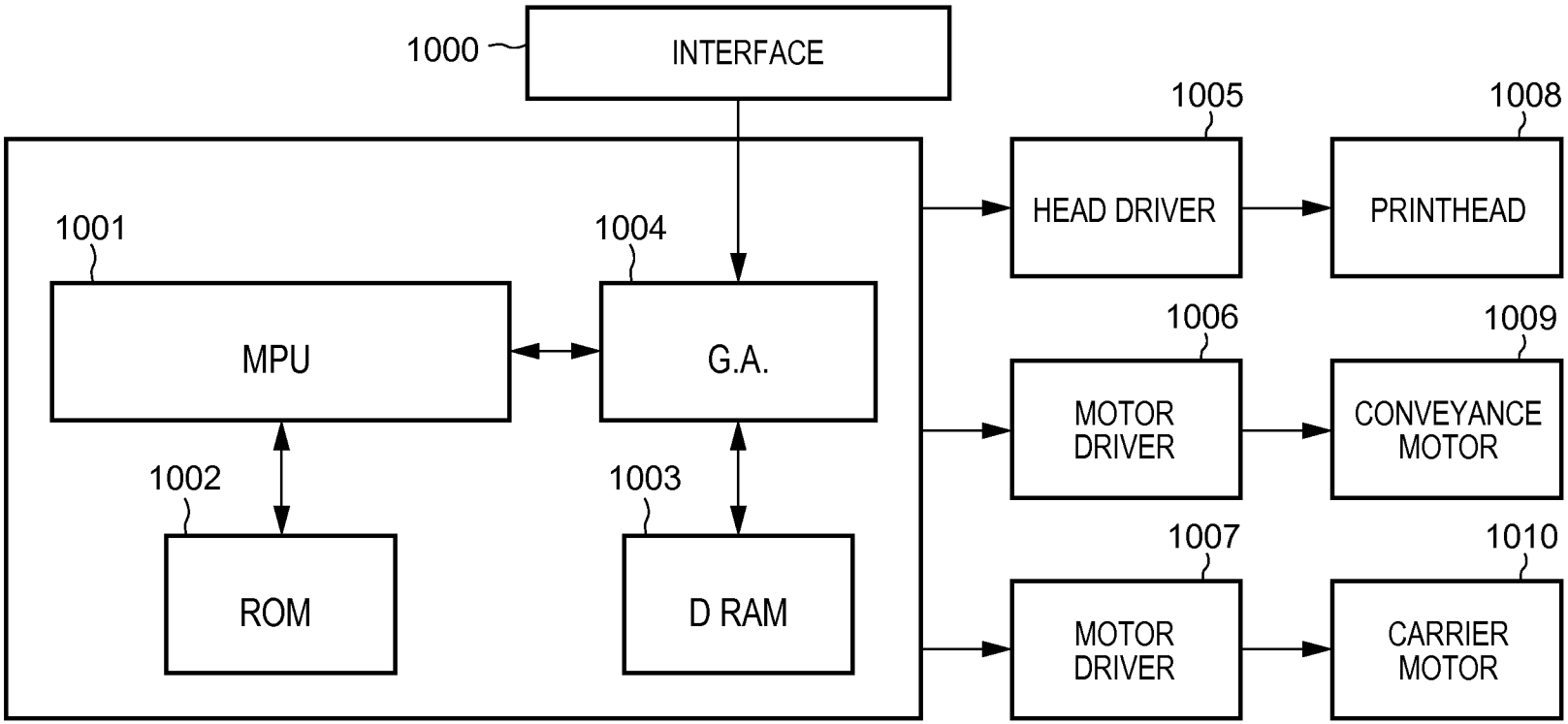

The arrangement of a control circuit configured to perform printing control of the above-described apparatus will now be described. FIG. 8D is a block diagram showing the arrangement of the control circuit of the inkjet printing apparatus 900. The control circuit includes an interface 1000 which receives a printing signal, an MPU (microprocessor) 1001, a program ROM 1002, a dynamic RAM (Random Access Memory) 1003, and a gate array 1004. The program ROM 1002 stores a control program to be executed by the MPU 1001. The dynamic RAM 1003 saves various data such as the above-described print signal and print data to be supplied to a printhead. The gate array 1004 controls supply of print data for a printhead 1008, and also controls data transfer between the interface 1000, the MPU 1001, and the RAM 1003. This control circuit further includes a carrier motor 1010 configured to carry the printhead 1008 and a conveyance motor 1009 configured to convey a printing paper. This control circuit also includes a head driver 1005 which drives the printhead 1008, and motor drivers 1006 and 1007 configured to drive the conveyance motor 1009 and a carrier motor 1010, respectively.

The operation of the above-described control arrangement will be described. When the print signal is input to the interface 1000, it is converted into print data for printing between the gate array 1004 and the MPU 1001. Then, the motor drivers 1006 and 1007 are driven, and the printhead is also driven in accordance with the print data that has transmitted to the head driver 1005, thereby performing printing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-161896, filed Aug. 7, 2014, which is hereby incorporated by reference wherein in its entirety.

What is claimed is:

1. A liquid discharge head substrate comprising:

a discharge unit including a discharge element configured to generate energy for discharging a liquid from an orifice and a discharge control circuit configured to control the discharge element; and a first voltage generation circuit configured to supply, to the discharge control circuit, a first driving voltage for driving the discharge control circuit, wherein the discharge unit includes a first node having a voltage correlated with a voltage to be supplied to the discharge element, and the first voltage generation circuit controls the first driving voltage based on a comparison result of the voltage of the first node and a first reference voltage supplied from outside of the liquid discharge head substrate.

2. The substrate according to claim 1, comprising a plurality of the discharge units, wherein the plurality of discharge units includes a monitoring unit where the voltage of the first node is supplied to the first voltage generation circuit and a liquid discharge unit where the voltage of the first node is not supplied to the first voltage generation circuit, and the first voltage generation circuit supplies the first driving voltage to each of the plurality of discharge units.

3. The substrate according to claim 2, wherein a driving signal for controlling driving of the discharge control circuit is supplied to each of the plurality of discharge units, a monitoring signal not corresponding to image data is supplied, as the driving signal, to the monitoring unit, and a discharge signal corresponding to the image data is supplied, as the driving signal, to the liquid discharge unit.

4. The substrate according to claim 3, wherein a first sample-and-hold circuit is included between the first voltage generation circuit and the first node of the monitoring unit, and the first voltage generation circuit holds the voltage of the first node in the first sample-and-hold circuit in a state in which the monitoring signal is supplied to the control circuit of the monitoring unit, and then switches the signal supplied to the control circuit of the monitoring unit to the discharge signal.

5. The substrate according to claim 4, wherein the discharge control circuit further includes a second driving transistor, the first driving transistor, the discharge element, and the second driving transistor are connected in this order, and the discharge element is connected to a first main electrode of the second driving transistor and a second power supply is connected to a second main electrode of the second driving transistor.

6. The substrate according to claim 5, wherein each of the first driving transistor and the second driving transistor operates as a source follower for the discharge element.

7. The substrate according to claim 5, further comprising a second voltage generation circuit configured to supply a second driving voltage for driving the second driving transistor, wherein the discharge unit includes a second node having a voltage correlated with a voltage to be supplied to the discharge element, and the second voltage generation circuit controls the second driving voltage based on a comparison result of the voltage of the second node and a second reference voltage supplied from outside of the liquid discharge head substrate.

8. The substrate according to claim 7, comprising a plurality of the discharge units, wherein the voltage of the second node in at least one discharge unit of the plurality of discharge units is supplied to the second voltage generation circuit, and the second voltage generation circuit supplies the second driving voltage to each of the plurality of discharge units.

9. The substrate according to claim 7, wherein the second node is a portion where the discharge element and the first main electrode of the second driving transistor are connected to each other.

10. The substrate according to claim 1, wherein the discharge control circuit includes a first driving transistor configured to drive the discharge element and a control circuit configured to control an electrical connection of the first driving transistor by switching whether to supply, to the first driving transistor, the first driving voltage supplied from the first voltage generation circuit.

11. The substrate according to claim 10, wherein a first main electrode of the first driving transistor is connected to the discharge element, and a second main electrode of the first driving transistor is connected to a first power supply.

12. The substrate according to claim 10, wherein the first node is a portion where the discharge element and the first main electrode of the first driving transistor are connected to each other.

13. The substrate according to claim 10, wherein the first node is a portion where a control electrode of the first driving transistor and the control circuit are connected to each other.

14. The substrate according to claim 10, wherein the first node is a portion where the first driving voltage is supplied from the first voltage generation circuit.

15. The substrate according to claim 1, wherein the first voltage generation circuit includes a first comparison circuit configured to compare the voltage of the first node with the first reference voltage, and the first voltage generation circuit controls the first driving voltage such that the voltage of the first node approaches the first reference voltage.

16. The substrate according to claim 1, wherein the first reference voltage is supplied from a liquid discharge apparatus.

17. A liquid discharge head substrate comprising:

a discharge unit including a discharge element configured to generate energy for discharging a liquid from an orifice and a discharge control circuit configured to control the discharge element; and a first voltage generation circuit configured to supply, to the discharge control circuit, a first driving voltage for driving the discharge control circuit, wherein the first voltage generation circuit controls the first driving voltage based on a comparison result of a voltage of one terminal of the discharge element and a first reference voltage supplied from outside of the liquid discharge head substrate, and wherein the one terminal of the discharge element has a voltage correlated with a voltage to be supplied to the discharge element.

18. A liquid discharge head comprising:

a liquid discharge head substrate and a liquid supply unit, wherein the liquid discharge head substrate comprises:

a discharge unit including a discharge element configured to generate energy for discharging a liquid from an orifice and a discharge control circuit configured to control the discharge element; and a first voltage generation circuit configured to supply, to the discharge control circuit, a first driving voltage for driving the discharge control circuit, the discharge unit includes a first node having a voltage correlated with a voltage to be supplied to the discharge element, the first voltage generation circuit controls the first driving voltage based on a comparison result of the voltage of the first node and a first reference voltage supplied from outside of the liquid discharge head substrate; and the liquid supply unit is configured to supply a liquid to the liquid discharge head substrate.

19. A printing apparatus comprising:

a liquid discharge head which comprising a liquid discharge head substrate and a liquid supply unit, and a driving unit, wherein the liquid discharge head substrate comprises:

a discharge unit including a discharge element configured to generate energy for discharging a liquid from an orifice and a discharge control circuit configured to control the discharge element; and a first voltage generation circuit configured to supply, to the discharge control circuit, a first driving voltage for driving the discharge control circuit, the discharge unit includes a first node having a voltage correlated with a voltage to be supplied to the discharge element, the first voltage generation circuit controls the first driving voltage based on a comparison result of the voltage of the first node and a first reference voltage supplied from outside of the liquid discharge head substrate;

the liquid supply unit is configured to supply a liquid to the liquid discharge head substrate; and the driving unit is configured to drive the liquid discharge head.

* * * * *